US006506530B1

(12) United States Patent
Kido et al.

(10) Patent No.: US 6,506,530 B1
(45) **Date of Patent: *Jan. 14, 2003**

(54) COLOR TONER FOR DEVELOPING ELECTROSTATIC IMAGE, COMPRISING FIRST LINEAR POLYESTER AND SECOND NON-LINEAR POLYESTER AS BINDER RESIN

(75) Inventors: Kenichi Kido, Nishinomiya (JP); Masayuki Hagi, Mino (JP); Megumi Aoki, Itami (JP); Yoshihiro Mikuriya, Nishinomiya (JP); Takeshi Arai, Akashi (JP); Tetsuo Sano, Amagasaki (JP); Yoshitaka Sekiguchi, Nishinomiya (JP); Junichi Tamaoki, Sakai (JP)

(73) Assignee: Minolta Co., Ltd., Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/584,178

(22) Filed: May 31, 2000

(30) Foreign Application Priority Data

Jun. 3, 1999 (JP) ..... 11-156508
May 1, 2000 (JP) ..... 2000-132310

(51) Int. Cl.[7] ..... G03G 9/087
(52) U.S. Cl. ..... 430/108.8; 430/109.4; 430/111.4
(58) Field of Search ..... 430/109, 110, 430/106.6, 109.4, 108.8, 111.4

(56) References Cited

U.S. PATENT DOCUMENTS

| | | | | |
|---|---|---|---|---|
| 4,142,982 A | | 3/1979 | Yamakami et al. | 252/62.1 |
| 4,533,614 A | | 8/1985 | Fukumoto et al. | |
| 4,590,139 A | | 5/1986 | Imai et al. | 430/45 |
| 4,657,837 A | | 4/1987 | Morita et al. | 430/109 |
| 4,863,824 A | | 9/1989 | Uchida et al. | 430/109 |
| 5,429,898 A | * | 7/1995 | Sugizaki et al. | 430/45 |
| 5,541,030 A | | 7/1996 | Sano et al. | 430/106.6 |
| 5,578,409 A | | 11/1996 | Kotaki et al. | |
| 5,660,963 A | | 8/1997 | Doujo et al. | 430/107 |
| 5,663,027 A | * | 9/1997 | Kohri et al. | 430/106.6 |
| 5,776,647 A | | 7/1998 | Kido et al. | |
| 5,814,428 A | | 9/1998 | Kido et al. | 430/110 |
| 5,824,446 A | | 10/1998 | Nishihara et al. | |
| 5,843,605 A | | 12/1998 | Anno et al. | 430/45 |
| 5,908,726 A | * | 6/1999 | Inoue et al. | 430/106.6 |
| 6,051,356 A | * | 4/2000 | Nishihara et al. | 430/110 |

FOREIGN PATENT DOCUMENTS

| | | | |
|---|---|---|---|
| EP | 0 662 640 A2 | | 7/1995 |
| GB | 2 100 873 A | | 1/1983 |
| JP | 60067958 A | | 4/1985 |
| JP | 7-261459 | * | 10/1995 |

OTHER PUBLICATIONS

English machine translation of JP 7–261459, Oct. 1995.*
Derwent Acc. No. 1995–386471, 1995.*

* cited by examiner

*Primary Examiner*—Christopher Rodee
(74) *Attorney, Agent, or Firm*—Burns, Doane, Swecker & Mathis, LLP

(57) ABSTRACT

The present invention provide a toner comprising:

a coloring agent;

a binder resin comprising a first binder resin and a second binder resin, the first binder resin being composed of a linear polyester resin having a number-average molecular weight (Mn) of from 2,800 to 7,000, a weight-average molecular weight (Mw) of from 8,900 to 21,000, and a Mw/Mn ratio of 2 to 4, the second binder resin being composed of a non-linear polyester resin having a number-average molecular weight (Mn) of from 3,500 to 8,000, a weight-average molecular weight (Mw) of from 40,000 to 120,000, and a Mw/Mn ratio of 10 to 20, and a ratio of the first binder resin to the second binder resin (the first binder resin:the second binder resin) being 60:40 to 95:5 by weight.

20 Claims, No Drawings

COLOR TONER FOR DEVELOPING ELECTROSTATIC IMAGE, COMPRISING FIRST LINEAR POLYESTER AND SECOND NON-LINEAR POLYESTER AS BINDER RESIN

This application is based on application No.156508/1999 and No. 132310/2000 filed in Japan, the contents of which are hereby incorporated by reference.

BACKGROUND OF THE INVENTION

1. Field of the Invention

The present invention relates to a color toner for developing electrostatic image suitably used in full color image-forming apparatuses such as a full color electrostatic copying machine, a full color laser beam printer and the like.

2. Description of the Related Art

In a full color image-forming method in electrophotography, the most significant properties required for toners were to have sharply melting properties so that toner layers of various colors are instantaneously melted by heat, mixed and develop color in a fixing process in order to form full color images by laminating toner images of a magenta toner, a cyan toner, an yellow toner and a black toner (U.S. Pat. Nos. 4,142,882, 4,590,139 etc.). However, such toners had high viscosity, extremely low elasticity, and small intermolecular coagulation force when toners melted by heat, causing a problem of offset onto a heat roller (particularly, offset at higher temperatures). Such a problem was remarkable, particularly when a roller is deteriorated due to repeated use, and when images such as full color images (for example, photographic image) having a large toner-adhered area and having a large toner amount on a toner support member (such as paper and the like) are copied.

On the other hand, with the prevalence of color printers and copying machines having high image quality, the number of sheet with copied color images increases dramatically. Further high speed is required. Under such recent conditions, toners giving small change of image gloss in continuous copying are in need. If change of image gloss is significant, appearances, namely, color and color reproducibility are felt significantly different by person.

However, when a conventional toner of which sharply melting properties are emphasized is used, there is a problem that image gloss changes significantly in continuous copying. Speedup of copying makes this problem more remarkable. Such a gloss change is believed to be derived from lowering of fixing roller temperature due to gradual deprivation of heat on the surface of the fixing roller by paper. Further, when continuous copying is conducted using A4 paper at longitudinal direction before copying using A4 paper at transverse direction, different gloss occurs on one sheet of image paper. This is problematical. In more detail, when A4 paper is used at longitudinal direction, both end portions of a fixing roller are not used for fixing, whereas, when A4 paper is used in transverse direction, both end portions of a fixing roller are also used for fixing as well as center portions. Therefore, temperature difference between the center portions and both end portions of a fixing roller occurs in copying in longitudinal direction of A4 paper, and when copying is conducted at transverse direction of A4 paper, high gloss portions and low gloss portions appear on one sheet of copied images. The problems of gloss change (difference) by continuous copying and gloss change (difference) on one sheet of copied images (hereinafter, simply referred to as "gloss change") are particularly remarkable in cold regions and after switch on.

U.S. Pat. No. 4,657,837 and G.B. No.2,100,837 propose a technology in which a polyester composed of an etherified bisphenol monomer and a divalent carboxylic acid monomer is cross-linked with a large amount of not less than tri-valent alcohol monomer and/or a not less than tri-valent carboxylic acid monomer, to give a polyester which is used as a binder resin. A toner obtained by using this binder resin can suppress offset at higher temperature and gloss change with change of fixing temperature. However, due to poor sharply-melting properties, the toner can not be fixed at lower temperature and color developing properties becomes problematical (lower temperature fixing properties).

Japanese Patent Application Laid-Open No. 60-67,958 proposes a technology in which two kinds of resins, or a non-linear polyester and linear polyester are so blended that the amount of the non-linear polyester is dominant. As a result of investigations of this binder resin by the present inventors, it is known that though offset at higher temperature and change of gloss with change of fixing temperature can be suppressed to a certain extent, the desired fixing properties at lower temperature can not be achieved.

SUMMARY OF THE INVENTION

The present invention is to provide a color toner for developing electrostatic images, which can suppress gloss change with change of fixing temperature, and is excellent in offset-resistance and fixing properties at lower temperature.

The present invention relates to a toner comprising:

a coloring agent;

a binder resin comprising a first binder resin and a second binder resin, the first binder resin being composed of a linear polyester resin having a number-average molecular weight (Mn) of from 2,800 to 7,000, a weight-average molecular weight (Mw) of from 8,900 to 21,000, and a Mw/Mn ratio of 2 to 4, the second binder resin being composed of a non-linear polyester resin having a number-average molecular weight (Mn) of from 3,500 to 8,000, a weight-average molecular weight (Mw) of from 40,000 to 120,000, and a Mw/Mn ratio of 10 to 20, and a ratio of the first binder resin to the second binder resin (the first binder resin:the second binder resin) being 60:40 to 95:5 by weight.

DETAILED DESCRIPTION OF THE INVENTION

The toner of the present invention comprises, at least, a binder resin, and a coloring agent, and uses two kinds of resins having different molecular weight (first binder resin; lower molecular weight, second binder resin; higher molecular weight,) as the binder resin.

The first binder resin is a linear polyester having a number-average molecular weight (in this specification, referred to as Mn) from 2,800 to 7,000, preferably from 3,000 to 6,000, a weight-average molecular weight (in this specification, referred to as Mw) from 8,900 to 21,000, preferably from 9,000 to 20,000, and a Mw/Mn ratio from 2.0 to 4.0, preferably from 2.1 to 3.5.

In the first binder resin, when Mn is less than 2,800 or Mw is less than 8,900, an effect for suppressing gloss change against change of fixing temperature is not obtained, and en effect to prevent offset at higher temperatures is not obtained. Further, lowering of Tg is caused, and toner storing properties (blocking-resistance) under high temperature deteriorates, in addition, the resin becomes too fragile, and in stirring in a developing vessel, a toner becomes a fine particles, deteriorating durability. When Mn is over 7,000 or Mw is over 21,000, heat-melting properties is inferior, fixing strength at relatively lower temperatures becomes weak, in addition, an image having appropriate gloss can not be obtained at relatively lower fixing temperatures. Further, resin becomes too hard, and pulverizing properties in producing a toner deteriorates. When Mw/Mn is lower than 2, the molecular weight distribution is too narrow, causing offset at higher temperatures in fixing. When Mw/Mn is over 4.0, fixing strength at relatively lower temperatures becomes weaker, in addition, an image having appropriate gloss can not be obtained at relatively lower fixing temperatures. Further, sharply melting properties decreases, the translucency and color-mixing properties of a toner decrease in the fixed image, the reproducibility of color deteriorates, and an excellent full color image can not be obtained. Further, by using a linear polyester as the first binder resin, the first binder resin can have sharply melting properties, and fixing properties at lower temperature when two kinds of resins are blended can be maintained. The linear polyester means a linear polyester having no branched chain.

In the present specification, the number-average molecular weight (Mn) and the weight-average molecular weight (Mw) of a resin are values measured by using gel permeation chromatography (GPC) (type 807-IT: made by Nippon Bunko Kogyo K.K.). Specifically, 30 mg of a sample to be measured is dissolved in 20 ml of tetrahydrofuran. This solution (0.5 mg) is introduced into an apparatus while keeping a column at 40° C. and passing tetrahydrofuran at 1 kg/cm$^2$ as a carrier solvent through the column. The molecular weights are calculated in terms of polystyrene.

It is desirable that the first binder resin in the present invention has a softening point (in the present specification, referred to as Tm) from 80 to 125° C., preferably from 85 to 115° C., more preferably from 90 to 110° C. and a glass transition point (in the present specification, referred to as Tg) from 45 to 80° C., preferably from 50 to 75° C., more preferably from 55 to 70° C., from the standpoints of the heat-resistance (blocking-resistance), fixing strength, color mixing properties and color reproducibility of a toner.

In the present specification, the softening point (Tm) of a resin is a value obtained according to the following method. First, 1.0 g of a sample to be measured is weighed, and measurement is conducted under conditions of a temperature-raising speed of 3.0° C./min., a pre-heating time of 180 seconds, a load of 30 kg and a measuring temperature range from 60 to 180° C. using a flow tester (CFT-500, made by Shimazu K.K.) and a die of h1.0 mm×ϕ1.0 mm, and the temperature when a half of the above-mentioned sample has flown out is measured as a softening point (Tm) of the resin.

The glass transition point (Tg) of a resin is a value obtained according to the following method. A differential scanning calorimeter (DSC-200, made by Seiko Denshi K.K.) is used. A sample (10 mg) to be measured is weighed precisely and placed in an aluminum pan. α-alumina as a reference is placed in the aluminum pan. They are heated from normal temperature to 200° C. at a temperature raising speed of 30° C./min., then, cooled. Measurement is conducted at a temperature raising speed of 10° C./min. within a range from 20° C. to 120° C. A shoulder value of the main absorption peak in a range from 30° C. to 100° C. in the temperature raising process is measured as Tg.

Monomers constituting the first binder resin are not particularly restricted provided that they can form a linear polyester, and for example, known divalent acid monomers and dihydric alcohol monomers can be used.

The divalent acid monomer is not particularly restricted provided that it has two carboxyl groups, and examples thereof include fumaric acid, maleic acid, maleic anhydride, phthalic acid, phthalic anhydride, terephthalic acid, isophthalic acid, tetrachlorophthalic anhydride, malonic acid, succinic acid, glutaric acid, dodecenylsuccinic anhydride, n-octylsuccinic acid, n-dodecenylsuccinic acid, adipic acid, sebacic acid, azelaic acid and lower alkyl esters of these acids. The divalent acid monomer may be used in combination of two or more.

In the present invention, as to the divalent acid monomers constituting the first binder resin, it is preferable to mix for use an aliphatic acid monomer and an aromatic acid monomer among the above-mentioned monomers. Particularly, it is more preferable that a molar ratio of an aliphatic acid monomer to an aromatic acid monomer (aliphatic acid monomer:aromatic acid monomer) is from 5:5 to 9:1, preferably from 5:5 to 8:2, from the standpoints of the sharply melting properties, fixing properties at lower temperature, pulverizing properties, heat-resistance (blocking-resistance) and durability of a toner.

Examples of the aliphatic acid monomer include fumaric acid, maleic acid, maleic anhydride, malonic acid, succinic acid, glutaric acid, dodecenylsuccinic anhydride, n-octylsuccinic acid, n-dodecenylsuccinic acid, adipic acid, sebacic acid, azelaic acid and lower alkyl esters of these acids, and they may be used in combination of two or more. Examples of the aromatic acid monomer include phthalic acid, phthalic anhydride, terephthalic acid, isophthalic acid and lower alkyl esters of these acids, and the like, and they may be used in combination of two or more.

The dihydric alcohol monomer is not particularly restricted providing it has two hydroxyl groups, and examples thereof include ethylene glycol, propylene glycol, 1,4-butanediol, 2,3-butanediol, diethylene glycol, triethylene glycol, 1,5-pentanediol, 1,6-hexanediol, neopentylene glycol, 1,4-cyclohexanedimethanol, propylene glycol, dipropylene glycol, polyethylene glycol, polypropylene glycol, bisphenol A and derivatives thereof, hydrogenated bisphenol A, and the like. As the preferably dihydric alcohol monomer among these compounds, bisphenol A derivatives, particularly, polyoxypropylene(2.2)-2,2-bis(4-hydroxyphenyl)propane, polyoxyethylene(2.0)-2,2-bis(4-hydroxyphenyl)propane and the like.

The first binder resin can be produced by any known method. For example, above-described monomers are placed into a 4-necked flask. A reflux condenser, water-separating apparatus, nitrogen gas-introducing tube, thermometer and stirring apparatus are installed to this 4-necked flask. These are stirred for 5 to 15 hours to cause reaction, while introducing nitrogen into this flask through the above-mentioned nitrogen gas-introducing tube and simultaneously heating at 180 to 240° C. by a mantle heater. In this reaction, the reaction condition is traced by measuring an acid value. When a predetermined acid value is attained, the reaction is terminated to give a first binder resin. A molar ratio of the acid monomer to the alcohol monomer subjected to the reaction is about 5:5.

The second binder resin is a non-linear polyester having a Mn from 3,500 to 8,000, preferably from 4,000 to 7,000, a Mw from 40,000 to 120,000, preferably from 40,000 to 100,000, and a Mw/Mn ratio from 10 to 20, preferably from 10 to 19.

In the second binder resin, when Mn is less than 3,500 or Mw is less than 40,000, the elasticity is low, and an effect for suppressing gloss change against change of fixing temperature, which is an purpose of the present invention, is not obtained. Whereas, when Mn is over 8,000 or Mw is over 120,000, extreme deterioration of fixing strength is invited. When Mw/Mn is lower than 10, an effect for suppressing gloss change against change of fixing temperature is not obtained. When Mw/Mn is over 20, extreme deterioration of fixing strength is invited, and in addition, an image having appropriate gloss can not be obtained at relatively lower fixing temperatures. Further, by using a non-linear polyester as the second binder resin, behavior properties as elastomer can be imparted to the binder resin, being effective for gloss reduction and high temperature offset-resistance. The non-linear polyester means a branched polyester having a branched chain.

In the present specification, it is desirable that the second binder resin has a Tm from 105 to 155° C., preferably from 110 to 150° C., more preferably from 115 to 145° C. and a Tg from 55 to 85° C., preferably from 60 to 80° C., more preferably from 60 to 75° C., from the standpoints of the heat-resistance (blocking-resistance), fixing strength, color-mixing properties and color reproducibility of a toner.

Monomers constituting the second binder resin are not particularly restricted providing they can form a non-linear polyester, and for example, known polyvalent acid monomers and polyhydric alcohol monomers can be used.

The polyvalent acid monomer is not particularly restricted providing it has two or more carboxyl groups, and examples thereof include monomers exemplified as the above-mentioned divalent acid monomer, 1,2,4-benzenetricarboxylic acid, 1,2,4-cyclohexanetricarboxylic acid, 1,2,4-naphthalenetricarboxylic acid, 1,2,5-hexanetricarboxylic acid, 1,3-dicarboxyl-2-methyl-2-methylenecarboxylpropane, tetra(methylenecarboxy) methane, 1,2,7,8-octanetetracarboxylic acid, trimellitic acid, trimellitic anhydride, pyromellitic acid, pyromellitic anhydride and lower alkyl esters of these acid. The above-mentioned acid monomer may be used in combination of two or more.

In the present invention, it is more preferable to use, as the polyvalent acid monomers constituting the second binder resin, an aromatic acid monomer alone, among the above-mentioned monomers, from the standpoints of suppression of gloss change against change of the fixing temperature, heat-resistance (blocking-resistance) and durability of a toner.

Among the above-mentioned polyvalent acid monomers, examples of the aromatic acid monomer include phthalic acid, phthalic anhydride, terephthalic acid, isophthalic acid, 1,2,4-benzenetricarboxylic acid, 1,2,4-naphthalenetricarboxylic acid, trimellitic acid, trimellitic anhydride, pyromellitic acid, pyromellitic anhydride and lower alkyl esters of these acid.

The polyhydric alcohol monomer is not particularly restricted providing it has two or more hydroxyl groups, and examples thereof include monomers exemplified as the above-mentioned dihydric alcohol monomer, glycerin, sorbitol, 1,4-sorbitan, trimethylolpropane and the like. Among them, examples of the preferable polyhydric alcohol monomer include bisphenol A derivatives, particularly, polyoxypropylene(2.2)-2,2-bis(4-hydroxyphenyl)propane, polyoxyethylene(2.0)-2,2-bis(4-hydroxyphenyl)propane and the like. The above-mentioned alcohol monomers may be used in combination of two or more.

In the present invention, it is preferable to use, as the monomer constituting the second binder resin, a not less than tri-valent monomer (including acid monomer and alcohol monomer) in a proportion of 3 to 50 mol %, preferably from 5 to 25 mol % based on the total amount of monomers constituting the second resin, and it is more preferable to use, as the not less than tri-valent monomer, the above-mentioned trivalent acid monomers from the standpoint of cost. Further, when a negatively chargeable toner is produced, it is advantageous to use a trivalent acid monomer from the standpoint of chageability.

The second binder resin can be produced by any known method, and the same methods as for producing the first binder resin can be adopted.

The first binder resin and the second binder resin as described above are used in a ratio by weight (first binder resin:second binder resin) of 60:40 to 95:5. When the proportion of the first binder resin based on the total amount of the first binder resin and the second binder resin is less than 60% by weight, fixing ability at lower temperature can not be maintained. Namely, when the fixing temperature is set at a relatively lower value, the fixing strength lowers, and an image having appropriately gloss can not be obtained. On the other hand, when the proportion is over 95% by weight, an effect for suppressing gloss change against change of the fixing temperature is not obtained, and an effect to prevent offset at a high temperature can not be obtained.

In the present invention, other resins different from the first binder resin and the second binder resin may be mixed for use. The other resin is not particularly restricted providing it has compatibility or partial compatibility with the first binder resin and the second binder resin (for example, hybrid resin of styrene-acrylic acid copolymer and polyester). The usage of the other resin is suitably 10% by weight or less based on the mixed binder resin composed of the first binder resin, the second binder resin and the other resin. In the binder resin used in the present invention (mixed binder resin containing the first binder resin and the second binding resin), it is preferable that a content of components insoluble in tetrahydrofuran (hereinafter, referred to as THF-insoluble components) is 5% by weight or less from the standpoints of OHP translucency and fixing properties of toners at lower temperature. In the binder resin of the present invention, smaller amount of THF-insoluble components is preferable, and more preferable, the resin contains substantially no THF-insoluble component, that is, the content is 0% by weight. In the present specification, the THF-insoluble components are insoluble components (% by weight) obtained by dissolving a sample (2.0 g) in THF (250 ml) at normal temperature and washed with supersonic wave for 5 minutes, then, left for 24 hours.

The coloring agent constituting the toner of the present invention is not particularly restricted, and pigments and dyes conventionally known in the field of electrophotography can be used, and examples thereof include carbon black, aniline blue, chalcoil blue, chrome yellow, ultramarine blue, dupont oil red, quinoline yellow, methylene blue chloride, copper phthalocyanine, malachite green oxalate, lamp black, rose bengal, C.I. Pigment Red 48:1, C.I. Pigment Red 122, C.I. Pigment Red 57:1, C.I. Pigment Red 184, C.I. Pigment Yellow 97, C.I. Pigment Yellow 12, C.I. Pigment Yellow 17, C.I. Pigment Yellow 180, C.I. Pigment Yellow 162, C.I. Pigment Blue 15:1, C.I. Pigment Blue 15:3, and the like.

The content of the coloring agent is not particularly restricted, and usually, it is desirably from 2 to 10 parts by weight based on 100 parts by weight of the binder resin.

In the present invention, it is preferable to use the coloring agent in the form of a master batch prepared by dispersing the coloring agent previously in a resin compatible with the binder resin used, from the standpoint of dispersibility in the toner particle. Specifically, a resin compatible with the binder resin used, preferably, the binder resin used and the coloring agent are mixed in a proportion of the coloring agent of about 15 to 50 parts by weight based on 100 parts by weight of the resin, the mixture is melted and kneaded, then, cooled and pulverized to give a master batch. The master batch is preferably the one which passed a 0.5 to 4.0 mm mesh, and the usage thereof may advantageously be such an amount that the amount of the pigment contained in a master batch used is within the above-mentioned range.

The toner of the present invention preferably contains a releasing agent from the standpoint of offset-resistance. As the releasing agent, known agents conventionally used in the field of electrophotography can be used. Examples thereof include polyethylene wax, polyethylene wax of oxidation type, polypropylene wax, polypropylene wax of oxidation type, carnauba wax, sazol wax, rice wax, candelira wax, jojoba oil wax, bees wax, ester wax and the like. Among them, olefin wax, for example, polyethylene wax, polyethylene wax of oxidation type, polypropylene wax, polypropylene wax of oxidation type and the like are preferably used. In the present invention, it is further desirable to use olefin wax having a softening point from 110° C. to 160° C., preferably from 120° C. to 155° C. from the standpoints of gloss and translucency of images. A content of the releasing agent is not particularly restricted, but it is desirable that the content is from 0.5 to 7 parts by weight, preferably from 1 to 5 parts by weight based on 100 parts by weight of the binder resin, from the standpoints of offset-resistance, releasing agent-dispersing properties, toner charging properties, and image translucency. The releasing agent may be used in combination of two or more, and in this case, the total content of releasing agents may advantageously be within the above-mentioned range.

In the present specification, the softening point of the wax is a value obtained according to the following method. A differential scanning calorimeter (DSC-200, made by Seiko Denshi K.K.) is used, 10 mg of a sample to be measured is weighed precisely and placed in an aluminum pan, and $\alpha$-alumina as a reference is placed in the aluminum pan, they are heated from normal temperature to 200° C. at a temperature-raising speed of 30° C./min., then, cooled, and measurement is conducted at a temperature raising-speed of 10° C./min. within a range from 40° C. to 200° C., and the temperature at which the main heat absorption peak is shown in this temperature-raising process is measured as the softening point.

In the toner of the present invention, if necessary, a charge controlling agent, magnetic particles (only black toner) and the like can be appropriately compounded.

The toner of the present invention can contain, if necessary, a charge controlling agent for further stabilizing the chargeability thereof. The charge controlling agent is not particularly restricted, and a generally known negatively chargeable controlling agent which controls the toner to be charged negatively may be used. Examples thereof include metal complex of salicylic derivatives, calix arene-based compounds, organic boron compounds, fluorine-containing quaternary ammonium salt-based compounds, monoazo metal complex, aromatic hydroxycarboxylic acid-based metal complex, aromatic dicarboxylic acid-based metal complex and the like. Among them, colorless (white) compounds are suitably used for color toners. The content of the charge control agent is not particularly restricted, and usually, it is desirably from 0.5 to 5 parts by weight based on 100 parts by weight of the binder resin.

As the magnetic particles, iron particles, iron oxide particles, ferrite, nickel, magnetite and the like can be used. The content of the magnetic particles is not particularly restricted, and usually, it is desirably from 0.5 to 10 parts by weight based on 100 parts by weight of the binder resin.

The toner of the present invention can be produced by conventionally known methods, for example, a pulverization method, emulsifying dispersing granulation method and the like. The pulverization method is preferably adopted from the standpoints of production easiness and productivity. In the case of the pulverization method, for example, the above-mentioned binder resin and coloring agent, and if necessary a releasing agent, a charge control agent, and magnetic particles are mixed, melted, kneaded, cooled, roughly pulverized, finely pulverized, and classified to give a toner of the present invention. The volume-average particle size of the resulted toner of the present invention is preferably controlled to be 4 to 10 $\mu$m.

Further, to the toner of the present invention, external additives and cleaning agent may be added and mixed. When the external additive is used, examples thereof include a silica fine particle, titanium oxide fine particle, alumina fine particle, magnesium fluoride fine particle, silicon carbide fine particle, boron carbide fine particle, titanium carbide fine particle, zirconium carbide fine particle, boron nitride fine particle, titanium nitride fine particle, zirconium nitride fine particle, magnetite fine particle, molybdenum disulfide fine particle, aluminum stearate fine particle, magnesium stearate fine particle, zinc stearate fine particle, calcium stearate fine particle, metal titanate fine particle, metal silicate fine particle and the like. It is preferable that the fine particles are hydrophobicized with a silane coupling agent, titanium coupling agent, higher fatty acid, silicone oil and the like before use. The usage of the external additive is preferably from 0.1 to 3.0% by weight based on the toner.

As the cleaning agent, there can be used various organic fine particles such as styrenic compound, acrylic compound, methacrylic compound, benzoguanamine, silicone, teflon, polyethylene, polypropylene and the like which have been granulated by gas phase methods or wet polymerization methods such as emulsion polymerization, soap free emulsion polymerization, non-water dispersion polymerization and the like.

The toner of the present invention can be used as a mono-component developing agent using no carrier and two-component developing agent using a carrier together. The use in the form of a two-component developing agent is preferable. As the carrier to be used together with the toner of the present invention, known carriers can be used. For example, any of carriers composed of magnetic particles such as iron particles, ferrite and the like, coated carriers obtained by coating the surface of magnetic particles with a coating agent such as a resin and the like, dispersion type carriers obtained by dispersing magnetic fine particles in a resin, and the like can be used. In the present invention, the preferably carrier has an average particle size from 20 to 70 $\mu$m, preferably from 30 to 60 $\mu$m.

The following examples illustrate the present invention in more detail below, but do not limit the scope of the present invention.

EXAMPLE

Production of Binder Resin

As the binder resins in examples and comparative examples, first binder resins (lower molecular weight members) and second binder resins (higher molecular weight members) shown in Tables 1 and 2 were produced as described below. In producing the resins, as the alcohol monomer component, polyoxypropylene(2.2)-2,2-bis(4-hydroxyphenyl)propane (hereinafter, abbreviated as BPA-PO) and polyoxyethylene(2.0)-2,2-bis(4-hydroxyphenyl) propane (hereinafter, abbreviated as BPA-EO) were used, and as the acid monomer, terephthalic acid (hereinafter, abbreviated as TPA), fumaric acid (hereinafter, abbreviated as FA), trimellitic anhydride (hereinafter, abbreviated as TMA) were used.

Specifically, respective monomers were weighed so as to give molar ratios of monomers as shown in Table 1 and 2, and these were charged into a 2-liter 4-necked flask, and a reflux condenser, water-separating apparatus, nitrogen gas-introducing tube, thermometer and stirring apparatus were installed to this 4-necked flask, and these were stirred to cause reaction, while introducing nitrogen into this flask through the above-mentioned nitrogen gas-introducing tube and simultaneously heating by a mantle heater. In this reaction, the reaction temperature was from 180 to 240° C. In this reaction, the reaction condition was traced by measuring an acid value. When a predetermined acid value was attained, the reaction was terminated to give a binder resin (A-1 to A-10, and B-1 to B-11). In this procedure, the reaction time was from 5 to 10 hours. The number-average molecular weight (Mn), weight-average molecular weight (Mw), glass transition point (Tg), softening point and THF insoluble content (% by weight) of the resulted resin were measured, and shown in Tables 1 and 2, together with monomer composition rations (molar rations) of respective resins.

TABLE 1

| | First binder resin <lower molecular weight member> | | | | | | | | | |
|---|---|---|---|---|---|---|---|---|---|---|
| | Monomer composition | | | | Resin physical value | | | | | |
| | Acid monomer | | Alcohol monomer | | Molecular weight distribution | | | Heat properties | | THF insoluble components |
| Kind | FA | TPA | BPA-EO | BPA-PO | Mn | Mw | Mw/Mn | Tg | Tm | (wt %) |
| A-1 | 5 | 4 | 2 | 9 | 4500 | 13600 | 3.02 | 59.5° C. | 97.6°C. | 0 |
| A-2 | 5 | 4 | 4 | 7 | 3200 | 10800 | 3.38 | 56.2° C. | 92.0°C. | 0 |
| A-3 | 4.5 | 4.5 | 1.5 | 9.5 | 5600 | 17200 | 3.07 | 67.4° C. | 107.8°C. | 0 |
| A-4 | 6 | 3 | 5 | 6 | 4600 | 10200 | 2.22 | 57.2° C. | 92.4°C. | 0 |
| A-5 | 3 | 6 | 1 | 10 | 5900 | 19600 | 3.32 | 70.0° C. | 121.2°C. | 0 |
| A-6 | 8 | 1 | 8 | 3 | 3000 | 9200 | 3.07 | 51.4° C. | 83.4°C. | 0 |
| A-7 | 7 | 2 | 8 | 3 | 2600 | 8700 | 3.35 | 48.9° C. | 82.2°C. | 0 |
| A-8 | 4.5 | 4.5 | — | 11 | 7200 | 22000 | 3.06 | 65.4° C. | 113.1°C. | 0 |
| A-9 | 7 | 2 | 9 | 2 | 5100 | 9400 | 1.84 | 53.4° C. | 84.2°C. | 0 |
| A-10 | 4.5 | 4.5 | 1 | 10 | 4500 | 19200 | 4.27 | 66.5° C. | 111.4°C. | 0 |

TABLE 2

| | Second binder resin <higher molecular weight member> | | | | | | | | | | |
|---|---|---|---|---|---|---|---|---|---|---|---|
| | Monomer composition | | | | | Resin physical value | | | | | |
| | Acid monomer | | Alcohol monomer | | Not less than trivalent | Molecular weight distribution | | | Heat properties | | THF insoluble components |
| Kind | FA | TPA | BPA-EO | BPA-PO | TMA | Mn | Mw | Mw/Mn | Tg | Tm | (wt %) |
| B-1 | — | 7 | 3 | 7 | 2 | 5400 | 79200 | 14.67 | 66.0° C. | 119.9° C. | 0 |
| B-2 | — | 6 | 2 | 8 | 3 | 6700 | 92000 | 13.73 | 72.1° C. | 129.4° C. | 0 |
| B-3 | — | 8 | 5 | 4 | 1 | 4200 | 54000 | 12.86 | 65.1° C. | 117.4° C. | 0 |
| B-4 | — | 7 | 3 | 7 | 2 | 4200 | 78200 | 18.62 | 69.8° C. | 127.2° C. | 0 |
| B-5 | — | 6 | 1.5 | 8.5 | 3 | 6800 | 99400 | 14.62 | 76.4° C. | 138.4° C. | 0 |
| B-6 | — | 7 | 9 | 1 | 2 | 4100 | 42500 | 10.37 | 59.2° C. | 109.4° C. | 0 |
| B-7 | 3 | 4 | 3 | 7 | 2 | 4200 | 52300 | 12.45 | 62.4° C. | 116.4° C. | 0 |
| B-8 | — | 8 | 6 | 4 | 1 | 3200 | 39000 | 12.19 | 60.6° C. | 118.4° C. | 0 |
| B-9 | — | 6 | 1 | 9 | 3 | 8400 | 124000 | 14.76 | 70.4° C. | 128.3° C. | 0 |
| B-10 | — | 8 | 6.5 | 3.5 | 1 | 5400 | 48300 | 8.94 | 61.8° C. | 116.2° C. | 0 |
| B-11 | — | 5 | 1.5 | 8.5 | 4 | 4200 | 94800 | 22.57 | 63.4° C. | 126.3° C. | 2.0 |

Examples and Comparative Examples

For producing toners of Examples 1 to 12 and Comparative Examples 1 to 10, first binder resins and second binder resins shown in Tables 3 and 4 were dry blended by Henschel mixer at ratios by weight shown in Tables 3 and 4, and resulted blends were used as the binder resin.

In the examples and comparative examples, the above-mentioned binder resin used in the examples and comparative examples and a cyan coloring agent (C.I. Pigment Blue 15-3: made by Toyo Ink Seizo K.K.) were kneaded at a ratio of 7:3 (ratio by weight) by a pressure kneader, and the kneaded product was pulverized by a feather mill to give a coloring agent master batch.

The above-mentioned binder resin (93 parts by weight), 10 parts by weight of the above-mentioned master batch, and releasing agents shown in Tables 3 and 4 were used in amounts shown, mixed with Henschel mixer, and this mixture was kneaded by a twin screw extrusion kneader. The kneaded product was cooled. This kneaded product was coarsely pulverized by a feather mill, further finely pulverized by a jet mill, and classified to give toner particles having a volume-average particle size of 7.8 μm. To the resulted toner particles, 0.8% by weight of hydrophobic silica (H2000; made by Clarient Corp.) and 1.0% by weight of hydrophobic titania A having a degree of hydrophobicity of 60% produced as described below were added as external additives. The resultant mixture was mixed by Henschel mixer to give a toner of Examples 1 to 12 and Comparative Examples 1 to 11.

(Production of Hydrophobic Titania A)

Titania having an average primary particle size of 50 nm (STT-30; made by Titan Kogyo K.K.) was mixed by stirring in water, and to this was added n-hexyltrimethoxysilane in a such amount that the amount in terms of solid thereof was 20% by weight of the titania and they were mixed, and this mixture was dried and pulverized to give hydrophobic titania A having a degree of hydrophobicity of 60%.

As the carrier to be mixed with the above-mentioned toner, a resin-coated carrier produced as described below was used.

(Production Method for Carrier)

First, into a 500 ml flask equipped with a stirrer, condenser, thermometer, nitrogen-introducing tube and dropping funnel was added 100 parts by weight of methyl ethyl ketone. Separately, into 100 parts by weight of methyl ethyl ketone were dissolved 36.7 parts by weight of methyl methacrylate, 5.1 parts by weight of 2-hydroxyethyl methacrylate, 58.2 parts by weight of 3-methacryloxypropyltris(trimethylsiloxy)silane and 1 part by weight of 1,1'-azobis(cyclohexane-1-carbonitrile) under nitrogen atmosphere at 80° C., to give a solution. This solution was added dropwise into the above-mentioned flask over a period of 2 hours, and aged for 5 hours to give a resin. To the resulted resin was added isophorone diisocyanate/trimethylolpropane adduct (IPDI/TMP type: NCO%=6.1%) as a cross-linking agent so that OH/NCO molar ratio was 1/1, then, diluted with methyl ethyl ketone to give a coat resin solution having a solid proportion of 3% by weight. This coat resin solution was applied on a core material composed of calcined ferrite particles (F-300; made by Powder Tech K.K.) having an average particle size of 50 μm by Spira Coater (made by Okada Seiko K.K.) so that the coat resin amount was 1.5% by weight based on the core material. The coated material was dried, and the resulted carrier was left in a hot air cycling type oven at 160° C. for 1 hour for calcination. The calcined product was cooled, then, the ferrite powder bulk was pulverized by a sieve vibration apparatus equipped with a screen mesh having an opening of 106 μm and 75 μm, to give a resin-coated carrier.

To each (6 parts by weight) of the resulted toners was mixed 94 parts by weight of the above-mentioned resin coated carrier to give a starter. The following evaluations were conducted using this starter.

(Method for Measuring Image Glossiness)

Measurement of glossiness was conducted using a glossiness meter (GM-060; made by Minolta K.K.). Specifically, 1.5 cm×1.5 cm solid images <adhesion amount 2.0 mg/cm$^2$> were made by a full color copying machine (CF-900; made by Minolta K.K.), while changing the image fixing temperature gradually by 3° C. in a range from 122° C. to 170° C., and the glossiness of each image was measured by a glossiness meter (GM-060; made by Minolta K.K.).

Evaluation Method (Lower Limit of Gloss-Occurring Temperature)

The temperature at which glossiness reaches 15 which is the lower limit of the appropriate gloss was evaluated. When this temperature is less than 145° C., the evaluation is ◎, 145° C. or more and less than 150° C.: ○, 150° C. or more and less than 155° C.: Δ (practically no problem), and 155° C. or more: × (practically problematical).

(Glossiness Gradient)

The image glossiness against the fixing temperature obtained by the above-mentioned image glossiness measuring method was plotted (vertical axis; fixing temperature, horizontal axis; image glossiness), and an approximation line was drawn between a range from the lower limit glossiness 15 and the upper limit glossiness 40, and the gradient was measured. It is advantageous that this gradient is as low as possible. When the gradient is less than 1.5, the evaluation is ◎, when 1.5 or more and less than 1.7: ○, and when 1.7 or more: × (practically problematical).

(Fixing Lower Limit Temperature)

For this evaluation, 1.5 cm×1.5 cm solid images <adhesion amount 2.0 mg/cm$^2$> were made by a full color copying machine (CF-900; made by Minolta K.K.), while changing the fixing temperature gradually by 2° C. in a range from 120° C. to 170° C., and each image was folded at the center into two, and releasing of the image was visually evaluated, and the temperature between the fixing temperature at which the image was released slightly and the lower limit fixing temperature at which the image was not released at all was determined as the fixing lower limit temperature. When this fixing lower limit temperature is less than 142° C., the evaluation is ◎, 142° C. or more and less than 146° C.: ○, 146° C. or more and less than 152° C.: Δ (practically no problem), and 152° C. or more: × (practically problematical).

(High Temperature Offset Properties)

For this evaluation, half tone images were made by a full color copying machine (CF-900; made by Minolta K.K.) at a half fixing system speed, while changing the fixing temperature gradually by 5° C. in a range from 130° C. to 190° C., and offset condition was visually evaluated, and the temperature at which offset occurred was evaluated. When this offset occurring temperature is 168° C. or more, the evaluation is ◎, 160° C. or more and less than 168° C.: ○, 155° C. or more and less than 160° C.: Δ (practically no problem), and less than 155° C.: × (practically problematical).

(Method for Measuring Degree of Hydrophobicity)

In the present specification, the degree of hydrophobicity of an external additive was measured according to the following procedure. Into a 200 ml beaker was charged 50 ml of pure water. To this beaker was added 0.2 g of a sample to be measured. Methanol which had been dehydrated with anhydrous sodium sulfate was added to the beaker through a buret while stirring. Time when the sample was not recognized on the liquid surface was determined as the end point, and the degree of hydrophobicity was calculated according to the following formula using the amount (ml) of methanol required.

$$\text{Degree of hydrophobicity}=[\text{used amount of methanol}/(50+\text{used amount of methanol})]\times 100$$

TABLE 3

| | Binder resin | | | Releasing agent | | | Evaluation results | | | |
|---|---|---|---|---|---|---|---|---|---|---|
| | First binder resin (A) | Second binder resin (B) | A:B | Kind | Softening point | Addition amount (parts) | Lower limit of gloss-occurring temperature | Glossiness-gradient | Fixing lower limit temperature | High temperature offset |
| Ex. 1 | A-1 | B-1 | 80:20 | TS-200 | 145° C. | 2.0 | ◎ | ◎ | ◎ | ◎ |
| Ex. 2 | A-2 | B-2 | 70:30 | TS-200 | 145° C. | 1.0 | ○ | ◎ | ○ | ◎ |
| Ex. 3 | A-3 | B-3 | 90:10 | TS-200 | 145° C. | 3.0 | ◎ | ◎ | ◎ | ○ |
| Ex. 4 | A-4 | B-4 | 80:20 | TS-200 | 145° C. | 1.0 | ◎ | ◎ | ◎ | ◎ |
| Ex. 5 | A-1 | B-3 | 65:35 | TS-200 | 145° C. | 1.0 | ○ | ◎ | ○ | ◎ |
| Ex. 6 | A-1 | B-1 | 80:20 | 330P | 152° C. | 1.5 | ◎ | ◎ | ◎ | ◎ |
| Ex. 7 | A-1 | B-1 | 80:20 | 410P | 122° C. | 3.5 | ◎ | ◎ | ◎ | ◎ |
| Ex. 8 | A-5 | B-1 | 80:20 | TS-200 | 145° C. | 2.0 | Δ | ◎ | Δ | ◎ |
| Ex. 9 | A-6 | B-1 | 80:20 | TS-200 | 145° C. | 2.0 | ◎ | Δ | ◎ | Δ |
| Ex. 10 | A-1 | B-5 | 80:20 | TS-200 | 145° C. | 2.0 | Δ | ◎ | Δ | ◎ |
| Ex. 11 | A-1 | B-6 | 80:20 | TS-200 | 145° C. | 2.0 | ○ | Δ | ○ | ○ |
| Ex. 12 | A-1 | B-7 | 80:20 | TS-200 | 145° C. | 2.0 | ◎ | Δ | ◎ | ○ |

TABLE 4

| | Binder resin | | | Releasing agent | | | Evaluation results | | | |
|---|---|---|---|---|---|---|---|---|---|---|
| | First binder resin (A) | Second binder resin (B) | A:B | Kind | Softening point | Addition amount (parts) | Lower limit of gloss-occurring temperature | Glossiness-gradient | Fixing lower limit temperature | High temperature offset |
| Com. Ex. 1 | A-7 | B-1 | 72:25 | TS-200 | 145° C. | 2.0 | ◎ | X | ◎ | X |
| Com. Ex. 2 | A-8 | B-1 | 72:25 | TS-200 | 145° C. | 2.0 | X | ○ | X | ○ |
| Com. Ex. 3 | A-9 | B-1 | 72:25 | TS-200 | 145° C. | 2.0 | ◎ | Δ | ◎ | X |
| Com. Ex. 4 | A-10 | B-1 | 72:25 | TS-200 | 145° C. | 2.0 | X | ◎ | X | ◎ |
| Com. Ex. 5 | A-1 | B-8 | 72:25 | TS-200 | 145° C. | 2.0 | ◎ | X | ◎ | Δ |
| Com. Ex. 6 | A-1 | B-9 | 72:25 | TS-200 | 145° C. | 2.0 | ○ | ◎ | X | ◎ |
| Com. Ex. 7 | A-1 | B-10 | 72:25 | TS-200 | 145° C. | 2.0 | ◎ | X | ◎ | Δ |
| Com. Ex. 8 | A-1 | B-11 | 72:25 | TS-200 | 145° C. | 2.0 | X | ◎ | X | ◎ |
| Com. Ex. 9 | A-1 | B-1 | 50:50 | TS-200 | 145° C. | 2.0 | X | ◎ | X | ◎ |
| Com. Ex. 10 | A-1 | — | 100:0 | TS-200 | 145° C. | 2.0 | ◎ | X | ◎ | X |

In Tables 3 and 4, TS-200 means polypropylene wax (TS-200; made by Sanyo Kasei Kogyo K.K.), 330P means polypropylene wax (Viscol 330P; made by Sanyo Kasei Kogyo K.K.), 410P means polyethylene wax (Mitsui High Wax 410P; made by Mitsui Kagaku K.K.)

According to the present invention, a stable full color image can be obtained, while change of image gloss due to rising and lowering of fixing temperature is suppressesed.

According to the present invention, an image having excellent gloss can be obtained while maintaining lower temperature fixing properties.

According to the present invention, a full color image excellent in offset resistance can be formed with hardly adhering to a fixing roller.

What is claimed is:

1. A toner comprising:

a coloring agent;

a binder resin comprising a first binder resin and a second binder resin, the first binder resin comprising a linear polyester resin consisting of polymerized divalent acid monomers and dihydric alcohol monomers and having a number-average molecular weight (Mn) of from 2,800 to 7,000, a weight-average molecular weight (Mw) of from 8,900 to 21,000, and a Mw/Mn ratio of 2 to 4, the second binder resin comprising a non-linear polyester resin having a number-average molecular weight (Mn) of from 3,500 to 8,000, a weight-average molecular weight (Mw) of from 40,000 to 120,000, and a Mw/Mn ratio of 10 to 20, and a ratio of the first binder resin to the second binder resin (the first binder resin:the second binder resin) being 60:40 to 95:5 by weight.

2. The toner of claim 1, wherein said first binder resin has the number-average molecular weight of from 3,000 to 6,000, the weight-average molecular weight of from 9,000 to 20,000, and the Mw/Mn ratio of 2 to 3.5.

3. The toner of claim 1, wherein said second binder resin has the number-average molecular weight of from 4,000 to 7,000, the weight-average molecular weight of from 40,000 to 100,000, and the Mw/Mn ratio of 10 to 19.

4. The toner of claim 1, wherein said first binder resin has a softening point of 80 to 125° C. and a glass transition point of 45 to 80° C., and said second binder resin has a softening point of 105 to 155° C. and a glass transition point of 55 to 85° C.

5. The toner of claim 1, wherein the divalent acid monomers constituting said linear polyester resin comprise aliphatic acid monomers and aromatic acid monomers, and acid monomers constituting said non-linear polyester resin are selected from the group consisting of aromatic acid monomers.

6. The toner of claim 5, wherein a molar ratio of the aliphatic acid monomers to the aromatic acid monomers constituting said linear polyester resin (aliphatic acid monomer:aromatic acid monomer) is from 5:5 to 9:1.

7. The toner of claim 1, wherein a content in the binder resin of components insoluble in tetrahydrofuran is 5 percent by weight or less.

8. The toner of claim 7, wherein a content in the binder resin of components insoluble in tetrahydrofuran is substantially zero.

9. A toner of claim 1, further containing 0.5 to 7 parts by weight of olefin wax having a softening point of 110 to 160° C. on the basis of 100 parts by weight of the binder resin.

10. A cyan toner, a magenta toner, a yellow toner or a black toner used for forming a full color image, comprising:

a coloring agent;

a binder resin comprising a first binder resin and a second binder resin, the first binder resin comprising a linear polyester resin consisting of polymerized divalent acid monomers and dihydric alcohol monomers and having a number-average molecular weight (Mn) of from 2,800 to 7,000, a weight-average molecular weight (Mw) of from 8,900 to 21,000, and a Mw/Mn ratio of 2 to 4, the second binder resin comprising a non-linear polyester resin having a number-average molecular weight (Mn) of from 3,500 to 8,000, a weight-average molecular weight (Mw) of from 40,000 to 120,000, and a Mw/Mn ratio of 10 to 20 and a ratio of the first binder resin to the second binder resin (the first binder resin:the second binder resin) being 60:40 to 95:5 by weight.

11. The toner of claim 10, wherein said first binder resin has the number-average molecular weight of from 3,000 to 6,000, the weight-average molecular weight of from 9,000 to 20,000, and the Mw/Mn ratio of 2 to 3.5.

12. The toner of claim 10, wherein said second binder resin has the number-average molecular weight of from 4,000 to 7,000, the weight-average molecular weight of from 40,000 to 100,000, and the Mw/Mn ratio of 10 to 19.

13. The toner of claim 10, wherein said first binder resin has a softening point of 80 to 125° C. and a glass transition point of 45 to 80° C., and said second binder resin has a softening point of 105 to 155° C. and a glass transition point of 55 to 85° C.

14. The toner of claim 10, wherein the divalent acid monomers constituting said linear polyester resin comprise aliphatic acid monomers and aromatic acid monomers, and acid monomers constituting said non-linear polyester resin are selected from the group consisting of aromatic acid monomers.

15. The toner of claim 10, wherein a content in the binder resin of components insoluble in tetrahydrofuran is substantially zero.

16. A toner of claim 10, further containing 0.5 to 7 parts by weight of olefin wax having a softening point of 110 to 160° C. on the basis of 100 parts by weight of the binder resin.

17. The toner of claim 10, wherein said black toner contains 0.5 to 10 parts by weight of magnetic particles based on 100 parts by weight of the binder resin.

18. A cyan toner, a magenta toner, a yellow toner or a black toner used for forming a fall color image, comprising:

a binder resin comprising a first binder resin and a second binder resin, the first binder resin comprising a linear polyester resin consisting of polymerized divalent acid monomers and dihydric alcohol monomers and having a number-average molecular weight (Mn) of from 2,800 to 7,000, a weight-average molecular weight (Mw) of from 8,900 to 21,000, and a Mw/Mn ratio of 2 to 4, the second binder resin comprising a non-linear polyester resin having a number-average molecular weight (Mn) of from 3,500 to 8,000, a weight-average molecular weight (Mw) of from 40,000 to 120,000, and a Mw/Mn ratio of 10 to 20, and a ratio of the first binder resin to the second binder resin (the first binder resin:the second binder resin) being 60:40 to 95:5 by weight, and a resin dispersion colorant having a colorant dispersed at 15 to 50 parts by weight on the basis of 100 parts by weight of a resin compatible with the binder resin.

19. The toner of claim 18, wherein the resin dispersion colorant is obtained through steps of mixing the colorant with the resin compatible with the binder resin to give a mixture, melting and kneading the resultant mixture to give a kneaded material, and pulverizing the kneaded material.

20. The toner of claim 18, wherein said first binder resin has the number-average molecular weight of from 3,000 to 6,000, the weight-average molecular weight of from 9,000 to 20,000, and the Mw/Mn ratio of 2 to 3.5, and said second binder resin has the number-average molecular weight of from 4,000 to 7,000, the weight-average molecular weight of from 40,000 to 100,000, and the Mw/Mn ratio of 10 to 19.

* * * * *